United States Patent [19]

Desjardins

[11] 4,342,985

[45] Aug. 3, 1982

[54] REMOTE SENSING AND CONTROL SYSTEM

[75] Inventor: Paul A. Desjardins, Commack, N.Y.

[73] Assignee: Firecom, Inc., Woodside, N.Y.

[21] Appl. No.: 193,689

[22] Filed: Oct. 3, 1980

[51] Int. Cl.[3] ..... G08B 26/00

[52] U.S. Cl. ..... 340/525; 340/518; 340/505; 340/870.09; 340/825.1; 340/825.54

[58] Field of Search ..... 340/525, 505, 518, 506, 340/531, 534, 151, 152 R, 152 T, 164 R, 870.01, 870.09, 870.16, 825.07, 825.1, 825.11, 825.14, 825.2, 825.21, 825.52, 825.54, 825.62; 179/5 R, 5 P

[56] References Cited

U.S. PATENT DOCUMENTS

| | | | |
|---|---|---|---|
| 3,516,063 | 6/1970 | Arkin et al. | 340/505 |
| 3,665,399 | 5/1972 | Zehr et al. | 340/525 |
| 3,803,594 | 4/1974 | Klein et al. | 340/409 |
| 3,921,168 | 11/1975 | Dunbar | 340/408 |
| 4,019,172 | 4/1977 | Srodes | 340/146.1 |
| 4,030,095 | 6/1977 | Dalman | 340/413 |
| 4,067,008 | 1/1978 | Sprowls | 340/409 |

*Primary Examiner*—John W. Caldwell, Sr.
*Assistant Examiner*—Donnie L. Crosland
*Attorney, Agent, or Firm*—Nolte and Nolte

[57] ABSTRACT

A remote sensing and control system wherein a plurality of remote sensing units are connected to a central control and monitoring console by only four interconnecting wires. A clock signal is converted to a plurality of parallel address signals at the local monitoring console and also at the remote sensing units located up the building. A sync signal is employed to synchronize all of the serial to parallel converters in the system, and each remote unit is provided with a specific code and is identified by selectively routing one or more signals through an invertor located at each unit so that the signals trigger a logic device in the particular time slot assigned to each remote unit. The input circuitry of each remote sensing unit compares two fixed microvolt reference signals derived from the least significant bit of the address signals with the return signal from the sensing device to sense for opens, grounds, normal conditions, and alarms. The system is adapted to operate with conventional computing means and programmable read only memories, as well as a multiplexer unit, for providing control signals to operate controlling device upon the occurrence of predetermined signals from the sensing device.

21 Claims, 8 Drawing Figures

+
118
116
L
114
0
1
2
15
55
136
CRT
112
137
PRINTER
126
COMPUTING MEANS
BINARY TO 16 CONVERTOR
110
58
50
133
PROGRAMMABLE READ ONLY MEMORY
124
A
52
COMPARATOR MEANS
120
140
142
135
8-BIT MUX
STROBE
122
OR
"A" TO "J"
10
144
138
DIVIDE BY EIGHT COUNTER
44
48
127
CLOCK
40
42
108
SERIAL-TO-PARALLEL CONVERTOR
106
132
130
PULSE RESHAPER
CONTROL
45
104
129
BUFFER
139
CONTROL BUFFER
102
128
62
CLOCK BUFFER TO LINES UP THE BUILDING
100
SYNC BUFFER TO LINES UP THE BUILDING
146
MONITOR
46
CLOCK
56
SYNC
3B

REMOTE SENSING AND CONTROL SYSTEM

BACKGROUND OF THE INVENTION

The present invention relates generally to remote sensing and control systems and, specifically, to a detection and alarm system employing a plurality of remote sensing units which are directly connected to a central monitoring and control center.

There is presently a growing requirement for providing large buildings with systems which can detect emergency conditions. For example, in large apartment or office buildings, smoke detectors and the like may be located throughout the building with each detector then being connected to a central monitoring console, which is to be manned at all times. While the very first systems of this kind required each individual sensing unit to be directly connected by dedicated wires to the central control and monitoring console, various methods of reducing the number of wires needed to interconnect the units with the central console are now known.

It is important to reduce the number of interconnecting wires not only to reduce material costs, but also to reduce the amount of labor and time involved in installing the fire detection system into the building.

One approach toward reducing the large number of wires needed to connect a multiplicity of sensors is disclosed in U.S. Pat. No. 3,921,168, assigned to the assignee hereof. In that patent a system is shown which can permit a plurality of remote units to be connected in parallel to the monitoring and control center by a plurality of signal carrying wires, a monitoring wire, and a control wire. The number of remote units monitored and controlled may be as many $2^n$, where n is the number of signal carrying wires comprising the above-mentioned plurality. While this system afforded a major reduction in the number of interconnection wires necessary in large installations employing many remote sensing units, it may be seen that a relatively large number of signal carrying wires would still be required if, say, five hundred sensors are involved.

Another approach to reducing the number of wires required to connect a plurality of fire detection transponders to a central station is set forth in U.S. Pat. No. 4,067,008, wherein DC pulses are used to interrogate the plurality of sensors, each sensor and its associated transponder employs a counter which counts the interrogation pulses and will respond only after the particular interrogation pulses corresponding to the count assigned to that transponder have been received.

Another approach to decreasing the number of interconnection wires involves transmitting a specific word over a data bus to the sensing unit, in order to determine the status of each of the sensing units. Although this approach appears promising, a relatively large data bus is required by the system. Alternatively, time division multiplex (TDM) systems can be used for interrogating, in the manner generally known to the communications industry, a number of transponders connected to a central monitoring station.

While all of these systems are effective in reducing the number of interconnections required, they attendantly involve complex electronic units to code and decode the digital words and/or to provide time division multiplexing.

Another disadvantage in prior systems has been the inability of the system to cope with a grounded monitoring line. A grounded monitoring line can result from an integrated circuit failure, a shorted output transistor in the transponder, or a short to the building ground. A grounded monitoring line causes all devices to go into alarm and to call the Fire Department. This is an undesirable false alarm condition.

SUMMARY OF THE INVENTION

The present invention provides a system wherein a plurality of remote sensing units, up to five hundred twelve, are connected to a central control and monitoring console by only four interconnecting wires. Specifically, the remote units are connected in parallel to the monitoring and control center by a data receiving wire, a control signal wire, a clock wire, and a sync wire. Use of only four wires is made possible in the present invention by providing a system wherein a clock signal is converted to a plurality of signals of progressively doubled wave lengths or, conversely, the frequency is successively halved. All of these coded address signals are sent to a display unit; however, only the serial clock signal is sent up the building. Other convertors are located up the building for converting the serial clock signals into the identical set of coded address signals which were generated by the first convertor. A sync signal is employed to synchronize all of the converters in the inventive system. Each remote unit is provided with a specific code and is identified by selectively routing one or more signals through invertors located at each unit, so that the signals trigger the device in the particular time slot assigned to each remote unit. According to the open, closed, or grounded status of the particular remote sensing unit, a logic device sends a signal through the data receiving or monitoring wire for each unit in its specific time slot. The central control and monitoring console then sequentially monitors each remote unit in its individual time slot and indicates the status of all remote units to the operator. Each remote unit, in addition to its sensing function can include a relay which can be activated by a control signal from the control and monitoring console during the time slot for that unit. To achieve this computing means may be programmed to activate the relays of one or more of the remote units at the appropriate time slot.

The apparatus according to the present invention generates serial clock pulses which are converted in a serial to parallel convertor to a parallel address. This address is forwarded to a monitoring display, a control section, and a comparator section in the central console. The address is logically compared and when all of the addresses have been produced a sync pulse is produced, which is used to reset all serial to parallel convertors. The sync pulse is issued to the display and to the remote sensing circuitry, thereby causing all address lines to return to a zero state.

A strobe signal is produced which clocks the data to the display control and comparator sections. The clock and sync signals are sent up the building to each remote location, where they are reshaped and fed to a serial to parallel convertor. The addresses produced by the convertor are fed to the individual transponders.

The input circuitry of each remote sensing device compares two fixed microvolt reference signals derived from the least significant bit (LSB) of the address from the serial to parallel convertor, with the return signal from the sensing device and its end/of line component. The comparator unit senses for opens (trouble), grounds (trouble), normal, and alarms. A loss or reduction of return current indicates trouble or ground, and an increase in return current indicates an alarm. The outputs of the comparator unit are fed to a corresponding exclusive OR gate. The comparator unit operates such that if the signal is the same as that sent out to the remote device, then there is no change in the output of the exclusive OR, a normal is indicated, and a normal signal is sent. If the return signal is steady high, then the outputs of the comparator will cause a trouble signal to be sent to the control center in the time frame corresponding to that device. If the return signal has an increase in current, the comparator units feed this level shift to the exclusive OR gate. The result is an alarm signal being sent back to the central console.

Programmable read only memories (PROM) may also be used advantageously to send control signals on the control line to energize relays at the remote collection panels. It is also advantageous to use an eight-bit multiplexer provided with a number of manually actuatable switches, which permit selection of at least one of the remote actuating units. When the multiplexer sees the selected address, a control signal is placed on the control ine, so that only the relay whose time slot corresponds to the multiplexer output will be energized.

Additionally, a computing means such as a minicomputer can be used so that all control signals are derived from the computer's control logic. It is these control signals that are used, for example, to operate relays to shut down fans and to recall elevators. The kind of alarm, e.g., Manual Station, Elevator, Smoke, etc. will be displayed by the PROM package, as well as the on floor where the alarm originated and on the floor directly above. The local Fire Department can also be notified by a signal produced by the computer. The system can be easily programmed so that, if the computer fails, an audible and visible signal is produced. It is also possible to use the computer's own diagnostics to cause it to display or print out the kind of failure it is experiencing.

Therefore, it is an object of the present invention to provide a remote sensing and control system wherein the number of electrical interconnections between the sensing system and the indication system is minimized.

It is another object of the present invention to provide a remote sensing and control system wherein the sensing units are connected in parallel and are in communication with a central control and monitoring panel by means of only four lines.

It is a further object of the present invention to provide a remote sensing and control system wherein the sensing units are self checking and the status thereof may be constantly monitored.

The manner in which these and other objects are accomplished by the present invention will become clear from the following detailed description.

BRIEF DESCRIPTION OF THE INVENTION

Figure 1:
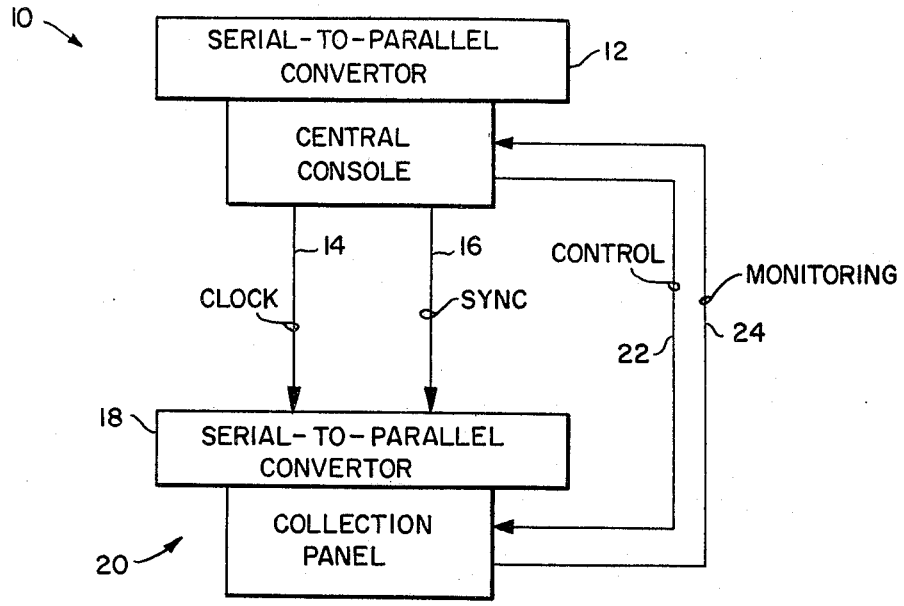
FIG. 1 is a block diagram showing the general operation of the present invention.

FIG. 1 is a block diagram showing the main functional units of the present invention. In order for the present invention to permit communication between a plurality of remote sensing devices and a central control console, the present invention teaches the use of serial to parallel convertors producing address signals, which have a progressively doubled wave length or, looked at another way, a progressively halved frequency. In the diagram of FIG. 1, the basic clock signal is generated in the central console unit, shown generally at 10. The control console unit 10 also includes a serial to parallel convertor 12. The portion of the invention corresponding to the central console unit 10 produces a clock signal or serial address signal on line 14 and a sync signal on line 16, which are both fed to a corresponding serial to parallel convertor 18. There is a serial to parallel convertor located at each group of remote sensing units, represented generally by a remote collection panel 20. The functions of the clock signal 14 and sync signal 16 will be explained in more detail hereinbelow. Additionally, when one or more remote actuating devices are employed, control signals for controlling the operation of such devices are sent from the central console on line 22. The data from the remote sensing units appears on line 24 which is termed a monitoring line. The arrowheads on the various interconnecting lines in FIG. 1 indicate the origin and termination of the four main signals of the present invention.

Figure 2:
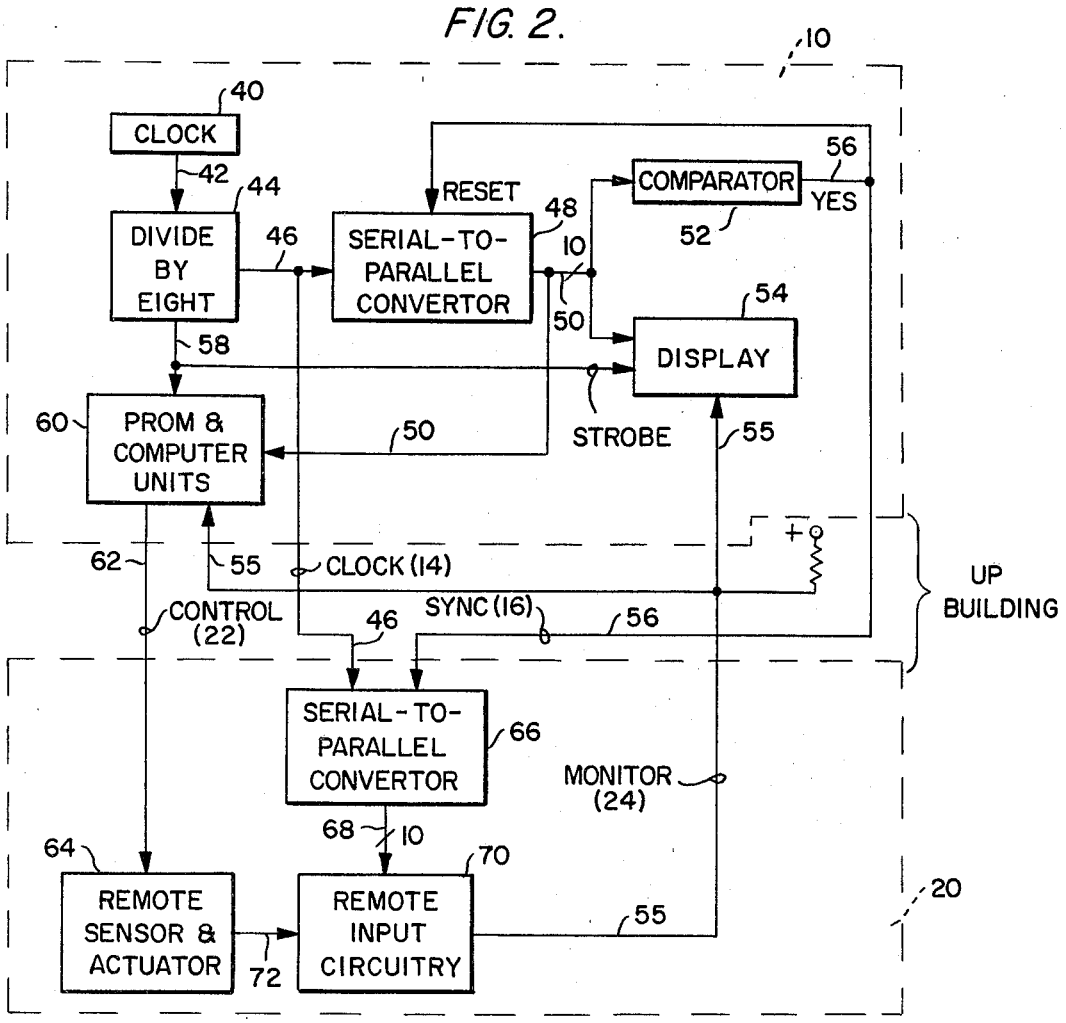
FIG. 2 is a block diagram showing the present invention in more detail.

FIG. 2 shows the block diagram of FIG. 1 in more detail. Specifically, all adresses and timing are derived from a clock unit 40, which in this embodiment has a frequency of 7.2 KHz. This clock 40 can be a quartz crystal controlled oscillator. The output signal from the clock 40 is fed on line 42 to a divide by eight counter 44. The divide by eight counter 44 produces a signal on line 46 which is 900 Hertz. This signal from the divide by eight counter 44 is fed on line 46 to a serial to parallel convertor unit 48, which produces ten parallel output signals on multilines 50. These outputs correspond to the ten address lines, denoted as A through J. By means of these ten lines, up to 1024 different addresses are possible in a binary system. These lines 50 are connected both to a comparator section 52 and to a display section 54. The specific waveforms of certain of the ten lines 50, A through J, will be shown hereinbelow.

The comparator section 52 operates as a ten input AND gate and serves to determine when all ten of the different address signals have been produced by the serial to parallel convertor 48. The comparator section 52 produces an output signal on line 56 which resets the serial to parallel convertor 48. Upon receiving the reset signal on line 56 the serial to parallel convertor 48 begins to reissue anew the set of ten identifying signals on multilines 50.

As pointed out above, each remote unit is assigned a particular address, represented by the instantaneous values of the ten different signals in ten preselected time slots, and it also has a corresponding indicator lamp (not shown) in the display unit 54. When each remote unit is addressed in turn depending upon the state of the signal on line 55, the display unit 54 will indicate a normal, trouble, or alarm condition.

The signal on line 56, which acts as the reset signal, is also employed as the sync signal on line 16 of FIG. 1. Thus, line 56 is one of the four lines which are fed up the building to the groups of remotely located sensing units. Similarly, the output signal on line 46 from the divide by eight counter 44 comprises the clock signal, which appeared on line 14 in FIG. 1. This clock signal on line 62 is also one of the four lines which are fed up the building.

A strobe signal having a frequency of 1.8 KHz is picked off from the divide by eight counter 44 prior to the point internal to the counter where the 900 Hz output signal is produced. This strobe signal on line 58 is fed to the display unit 54 to synchronize the display and also to PROM computer, and multiplexer units, shown generally at 60. The specific interconnections will be shown in more detail herein below. Also, as may be seen, the output of the serial to parallel convertor 48 on line 50, which comprises address lines A through J, is also fed to the computer and PROM units 60. These units 60 produce the control signals on line 62, which was line 22 in FIG. 1. As will be explained hereinbelow, the control signal on line 62 may be used to pull up a remotely located actuating device and is thus directly connected to the remote unit, located generally in the vicinity of the remote connection panel 20. On the other hand, the clock signal on line 46 and the sync signal on line 56 are fed to another serial to parallel convertor, which takes the serial signals and converts them to the ten address lines, corresponding to the A through J signals. These ten lines 68 are fed to specialized remote input circuitry, shown generally at 70. The input signals from each of the various remote sensor unit located generally in the same area are also fed through this generalized remote input circuitry 70. The remote input circuitry 70 ultimately produces the monitoring signal on line 55 which is fed back to the display unit 54 and the PROM and computer unit 60. This monitoring signal on line 55 is essentially a data line which is fed back to the display 54 and the PROM and computer unit 60 and serves to gate on the specific display device that corresponds to the remote sensor unit which has sensed either a trouble or alarm condition.

Figure 3A:
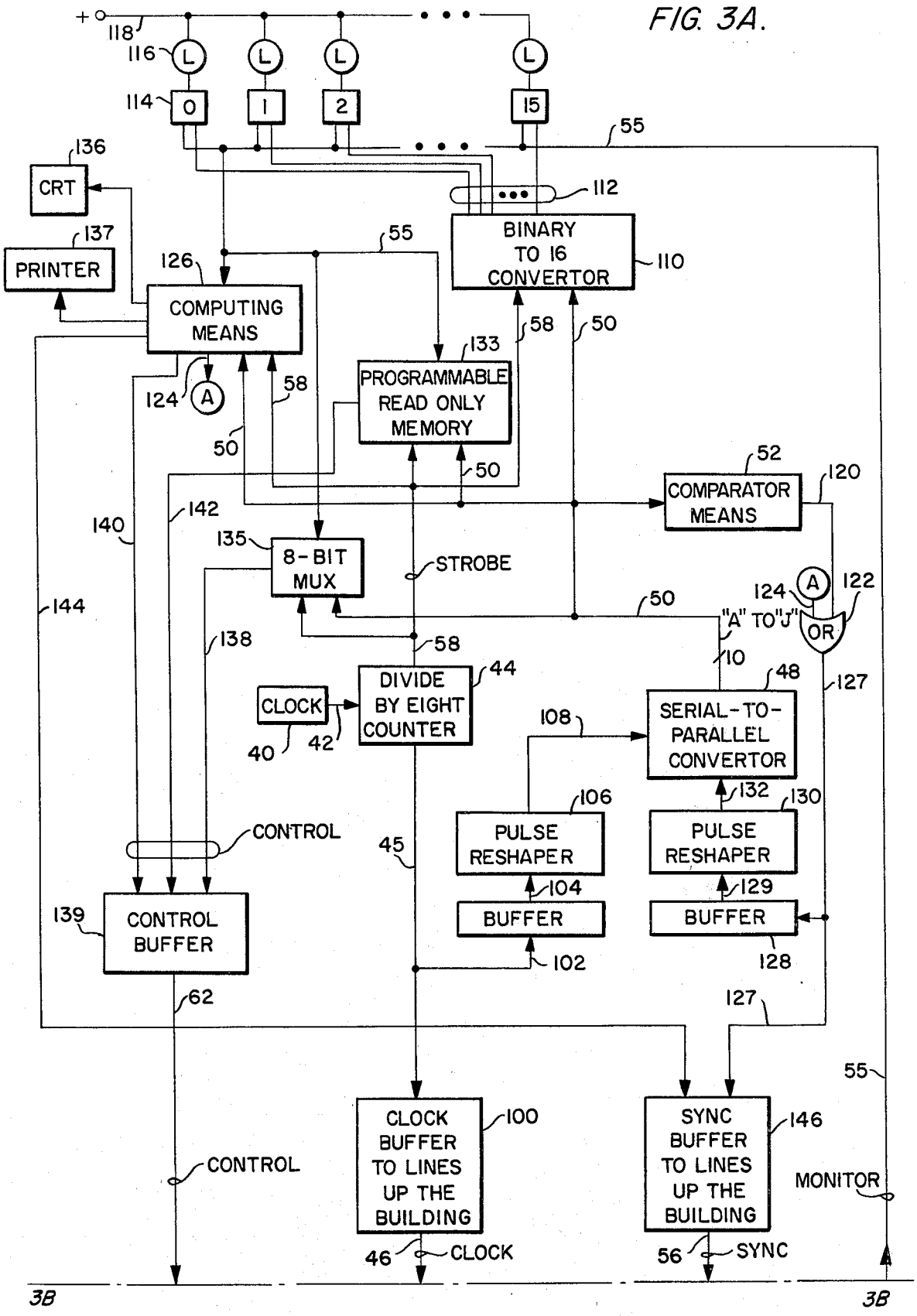
FIGS. 3A, and 3B comprise a schematic circuit diagram of the present invention.
Figure 3B:
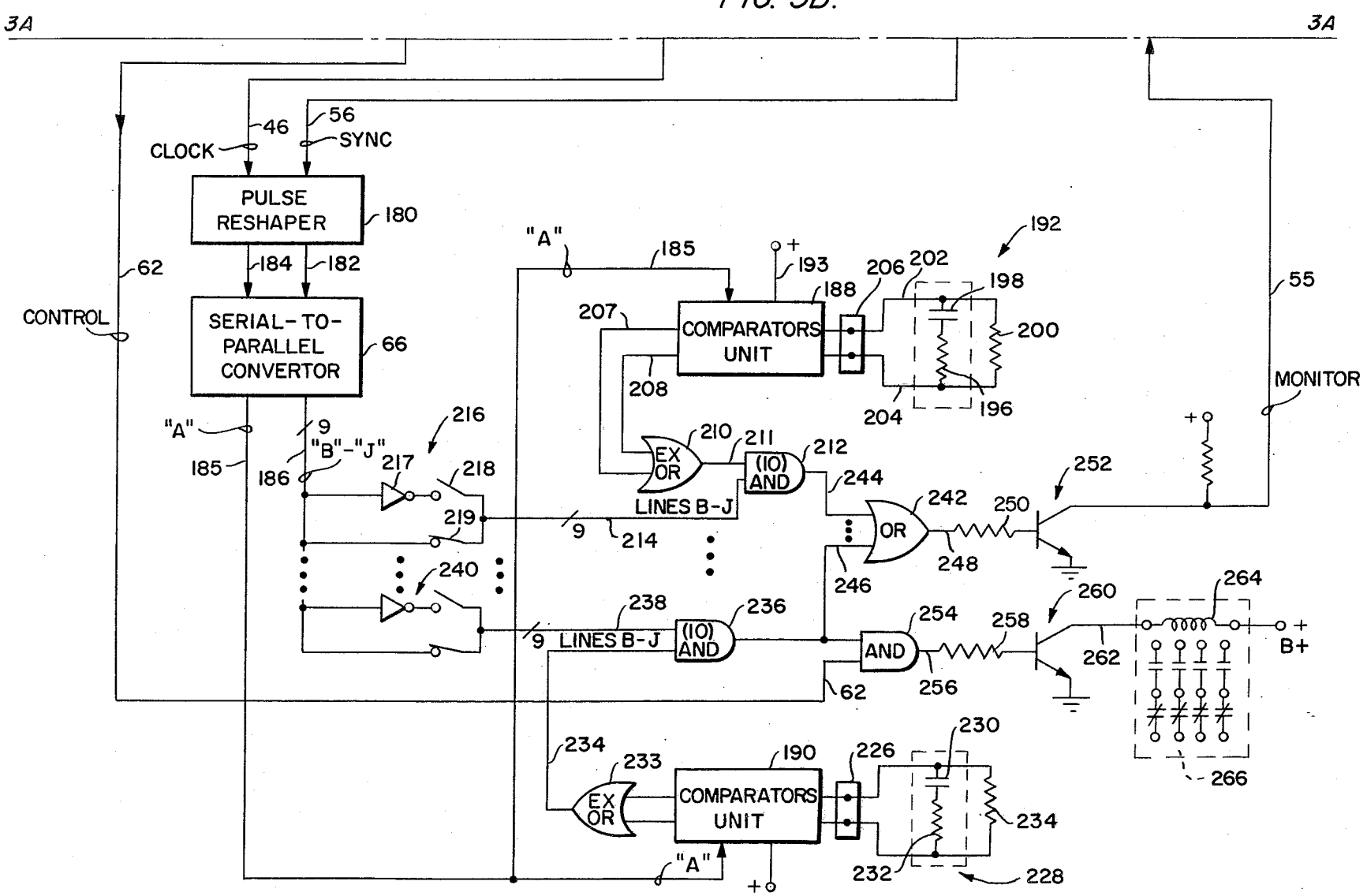

Referring now to FIGS. 3A and 3B, the inventive circuit, as shown in the generalized block diagrams of FIGS. 1 and 2, is expanded even further. Once again, the clock unit 40 produces a 7.2 KHz signal on line 42, which is fed to the divide by eight counter 44. The principal output of the divide by eight counter 44 appears on line 45 and is a 900 Hz signal. This signal is fed to a buffer unit 100, which adjusts the level of the divide by eight counter 44 signal. The output of the buffer 102 on line 104 is fed to a pulse reshaper 106, which compensates for any clipping or rounding of the signal waveform, which that may have occurred. Therefore, a buffered and reshaped signal on line 108 is fed to the serial to parallel convertor 48 it is the output of the serial to parallel convertor 48 that comprises the ten lines, A through J, which were fed to the display unit 54 of FIG. 2.

The serial parallel convertor 48 operates such that when the output signal from one stage has experienced two downwardly going leading edges, the output signal of the succeeding stage will change states. Thus, each succeeding stage will produce one pulse or change of state for each two pulses or changes of state in the preceding stage. This operation takes place in each successive stage of the convertor, which has the apparent effect of producing a plurality of parallel signals having progressively halved frequencies. This is not, however, strictly the case, since the frequencies of the successive lines are only relative to the preceding line and not to time, i.e., there are no half cycles involved.

The display unit comprises a binary to sixteen convertor 110, which converts the ten binary signals on lines 50 to sixteen individual signals appearing on the lines shown collectively as 112. Each of these sixteen lines 112 is fed to a corresponding flip-flop, one of which is shown typically at 114. Each flip-flop 114 also receives the data signal appearing on line 55, which is the monitoring line from the remote sensing units. The output from each flip-flop 114 is connected to a corresponding illumination means 116, which is also connected to a source of voltage, as represented by power line 118. Thus, upon the coincidence of a trouble or alarm signal on the monitor line 55 and the appropriate address from the binary to sixteen convertor, the corresponding flip-flop 114 will cause the corresponding lamp 116 to be illuminated at the display panel of the control console.

Figure 6:
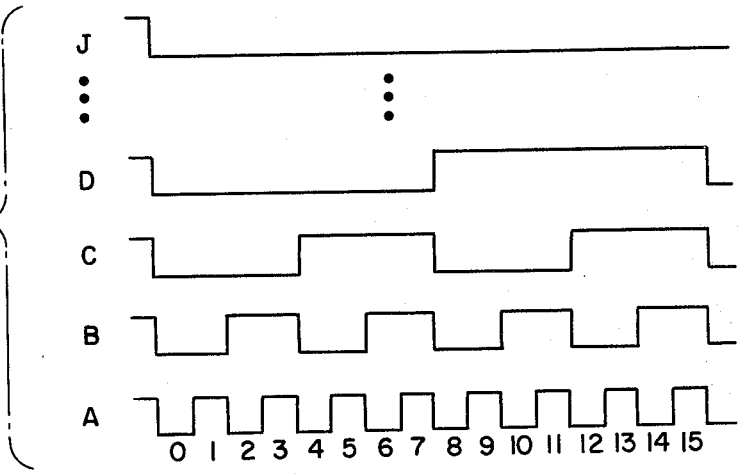
FIG. 6 is a graph of the waveforms showing the clocks generated time intervals in the present invention.

The address signals on multiline 50 from the serial to parallel convertor 48 are also fed to the comparator means 52, which is a logical AND device for determining when all of the ten address lines are high, a condition which will occur when the last of the output signals from the serial to parallel convertor 48 has been doubled in wave length or halved in frequency. This function of the comparator means 52 may be more fully appreciated when the waveforms shown in FIG. 6 are examined in detail hereinbelow. When all of the signals have been detected, i.e., when the serial to parallel convertor 48 has run through the entire list of the ten different signals, A through J, the comparator means 52 produces an output signal or a high level on line 120 which is connected to a logical OR gate 122. This OR gate 122 has as its second input a signal on line 124 from a computing means 126. When the comparator means 120 detects all of the ten possible output signals, A through J, from the serial to parallel convertor 48 and line 120 goes high, the output on line 127 of the OR gate 122 also goes high and acts as a reset signal, which is fed back to the serial to parallel convertor 48. First, however, the signal on line 127 is fed to a buffer unit 128 where it is adjusted in voltage level and fed out on line 129 to a pulse reshaper 130. The pulse reshaper 130 output signal on line 132 is a shaped pulse signal, which in turn resets the serial to parallel convertor 48 to cause it to begin once again converting the clock signals on line 108 into the A through J series of signals.

The divide by eight counter 44 also produces the strobe signal on line 58 at a frequency somewhat higher than the 900 Hz on line 45. This strobe signal is fed to the binary to sixteen convertor 110, the programmable read only memory (PROM) 133, the computing means 126, and an eight-bit multiplexer 135. This strobe signal serves to synchronize the operations of all of these several units with the several address signals used in the present invention. In regard to the computer means 126, it has been found that a 16-bit minicomputer, as manufacturered by Computer Automation Company, Inc., model LSI 4/10, can be advantageously used in the present embodiment.

The use of a computer base in this embodiment permits the addition of displays, printers, and other peripherals without expensive modifications. Connected in the standard manner, i.e., to the appropriate input/output ports of the computing means 126 are a cathode ray tube display 136 and a conventional hard copy printer 137. The address lines 50 and the data line 55 are fed to the multiplexer 135 which includes a plurality of command switches which may be manually set to select any one of the remotely located actuating units. Upon the 8-bit multiplexer 135 seeing an alarm signal on line 55 coincident with the address of the remote unit selected by the switches, a control signal is produced on line 138, which is fed to a control buffer unit 139. The output of this control buffer unit 139 is the control line 62 which is fed up the building.

Similarly, the computing means 126 is connected to receive the addresses on line 50 and the monitoring data on line 55. The computing means 126 can be programmed in advance to produce a control signal on line 140, upon the coincidence of an alarm signal on line 55 and the preselected remote unit address on multilines 50. This control signal on line 140 is fed to the control buffer 139, prior to sending it up the building.

The programmable read only memory 133 also receives the ten addresses on multiline 50 and the remote unit data on monitor line 55 and, provided that the PROM 153 contains the correct microcode, the appropriate control signal will be produced on line 142. The control signal on line 142 is also fed to the control buffer prior to sending it up the building. The purpose of these control signals will be explained in more detail hereinbelow.

The computing means 126 also produces a synchronization signal on line 144 which is fed to a sync buffer 146, where the signal is level adjusted prior to its being fed up the building on the sync line 56. The comparator means 52, which receives the ten address signals on line 50, is the principal element which is charged with the production of the sync signal for synchronizing the serial to parallel convertor units located at each of the remote sensing locations.

Referring now to FIG. 3B, which is a continuation of the circuit of FIG. 3A, and following the same numbering system employed in FIGS. 2 and 3A, the control signal emanating from the control buffer 139 appears on line 62, the clock signal emanating from the buffer 100 appears on line 46, the sync signal emanating from the sync buffer 146 appears on line 56, and the monitoring information being fed back to the display unit is on line 55. The clock signal 46 and the sync signal 56 are both fed to a pulse reshaper 180 where they are squared up. The sync signal 56 is then fed to the parallel to serial convertor 66 on line 182, and the clock signal 46 is similarly fed to the serial to parallel convertor 66 on line 184. This serial to parallel convertor 66 receives the clock signals in the identical manner as the serial to parallel convertor 48 received clock signals on line 108, after such signals had been buffered in buffer 102 and shaped in pulse shaper 106. As may be seen, these serial to parallel convertors also receive reshaped pulses from the pulse reshaper 180 that had previously been buffered by buffer unit 100. All serial to parallel convertor units are synchronized by the sync signal appearing on line 56, which is the same signal used to synchronize the main serial to parallel convertor 48 located at the central control and monitoring console.

There is no limit to the number of serial to parallel convertors 66 which can be located up the building, since the inventive system can handle an unlimited number of transponders. Additionally, because this embodiment of the present invention is designed using CMOS devices, there are no fan out constraints. This system is designed for 2048 points, which break down into four cables of 512 devices. The Underwriters Laboratory requires that only 32 transponders be connected to one serial to parallel convertor. Therefore, in this embodiment, this involves four cards, each having eight points on it. Thus, there are 32 transponders at each serial to parallel convertor 66 and, if 2048 points (transponders) are desired for monitoring purposes, then 64 serial to parallel convertors will be required up the building and one serial to parallel convertor at the central control and monitoring console.

The serial to parallel convertor 66 produces the least significant bit (LSB) of the address on the A line 185. The other nine lines of the address, B through J, are produced on the nine lines shown collectively at 186. The A line 185 is connected to eight separate comparators units, the first being 188 and the last being 190. It being understood that the remaining six comparators units are not shown for reasons of simplicity but would be connected just as comparators units 188 and 190.

Also conected to the comparators unit 188 is the remote sensing unit 192 and a suitable voltage source on line 193. The remote sensing unit 192 may be functionally represented by a resistor 196 and switch contacts 198, connected in parallel with an additional resistor 200 called an "end of line" resistor.

The remote sensing unit 192 is connected by lines 202, 204 through a plug-in connector, represented schematically at 206, to the comparator unit 188. The outputs of the comparators unit 188 are fed on lines 207, 208 to an exclusive OR gate 210. The plug member 206 is provided so that different types of sensing units may be easily connected and disconnected from the more permanent portion of the inventive system. The output of exclusive OR gate 210 appears on line 211 and is fed to an AND gate 212.

AND gate 212 is a ten input device which receives the sensing unit signal on line 211 from the exclusive OR gate 210 and also receives the remaining nine address signals, B through J, shown generally at 214. As indicated above, in this embodiment there are a total of eight 10-input AND gates identical to AND gate 212 on each of four cards which are plugged into the serial to parallel converter 66.

The nine other inputs to each 10-input AND gate, and to AND gate 212 in particular, are provided by nine separate identification units, or jumper/inverter units, such as the one shown at 216. The general operation of this identification unit is explained in detail in the aforementioned U.S. Pat. No. 3,921,168. There are a total of nine identification units for each remote sensing device employed in ths system and in FIG. 3B there will be a group of nine identification units, such as 216, connected to each of the nine lines, B through J. Each identification unit 216 consists of an inverter 217 connected to the appropriate address line, in this case line B, the inverter 217 is connected in series with a switch or jumper 218 and another switch or jumper 219 is also connected directly to the address line, i.e., the B line. By choosing the manner in which the switches 218, 219 are thrown, the output of the identification unit can be dictated for each occurance of a zero or one at the input. It should be remembered at this point that the address lines carry signals which have increasingly doubled wavelengths and, thus, at each successive 900

Hz clock pulse the high-low inter-relationship of the nine lines changes. Each remote sensing unit may then be individually identified by making or breaking the switches, e.g., 218 and 219, in the identification unit so that the inputs to the 10-input AND gate 212 are either inverted or not inverted.

For example, as will be shown hereinafter, the only time when the waveforms of all address lines are low is during the first time interval. Therefore, if it is desired that the nine identification units, represented by unit 216, are to identify sensing unit 192 as the first unit, then the switches in series with the invertors must be set closed and those in parallel must be set opened. Thus, at the first time interval AND gate 212 will be presented with nine high inputs and the state of the remote sensor 194 can be determined by the output of AND gate 212.

All comparators units, e.g., 188 and 190, in the system operate the same way. The inventive comparator arrangement is set up to sense for open trouble, ground trouble, normal, and alarm conditions. For example, a loss or reduction of the return current to the comparators unit means that the output on one of the lines, 207 or 208, of the comparator will be a steady high. This steady high is derived from a comparison with the least significant bit of the address, i.e., the A line 185 and the output of the sensing unit 192. The other conditions will be explained hereinbelow in relation to FIG. 7.

Similarly, the output of exclusive OR gate 233 on line 234 is fed to another 10-input AND gate 236. The other nine inputs to AND gate 236 are on line 238, which correspond to the B to J lines produced by the nine separate identifying units, one of which is shown at 240. As in all the identifying units, two jumpers or switches are provided, one being in series with an invertor. In this manner, the specific remote sensing unit 228 can be readily identified. It must be understood that there are six 10-input AND gates that have not been shown in FIG. 3B in the interest of clarity and simplicity. In other words, there are nine jumper and invertor units corresponding to units 215 and 240 for each of the six 10-input AND gates not shown. Similarly, there are also six other exclusive OR gates, corresponding to OR gates 210 and 233. Each AND gate, 212, 236, and those not shown, produces an output signal which is fed to an eight input OR gate 242. Specifically, the output from the first AND gate 212 of the eight appears on line 244 and the output from the last AND gate 236 of the eight appears on line 246. Upon the presence of a high input signal, OR gate 242 produces an output on line 248, which is fed through a base resistor 250 to a transistor 252. The output of this transistor 252, appearing on line 55, is the monitor line fed back to the display. This monitor line might be also characterized as a data output line.

By using the OR gate 242, the reliability of the inventive system is greatly improved because this will eliminate seven additional transistors corresponding to transistor 252. The elimination of transistor amplifiers in circuits such as the present one, goes a long way toward improving the reliability of the system.

Additionally, the output on line 246 from AND gate 236 is fed to another AND gate 254, which has as a second input the control signal on line 62, produced by the control buffer 139 of FIG. 3A. This AND gate 254 produces a signal on line 256 when the output on line 246 of AND gate 236 is high simultaneously with the control signal being present on line 62. The signal on line 256 is fed through a base drive resistor 258 to a transistor 260. The output of this transistor 260 appears on line 262 and is fed to the coil 264 of a relay unit 266, which represents a controlling device. The other side of the relay coil 264 is connected to a suitable B+ voltage. Relay 266 may consist of a number of four-pole, double-throw contacts, which may be used to ontrol any type of device, such as door locks, elevator controls, ventilator fans, etc.

Although only one actuating device 266, is shown connected to the output of AND Gate 254, additional corresponding actuating devices could be connected to the output of every corresponding AND gate in the system, e.g., to AND Gate 212, and to the single control signal on line 62.

Figure 4:
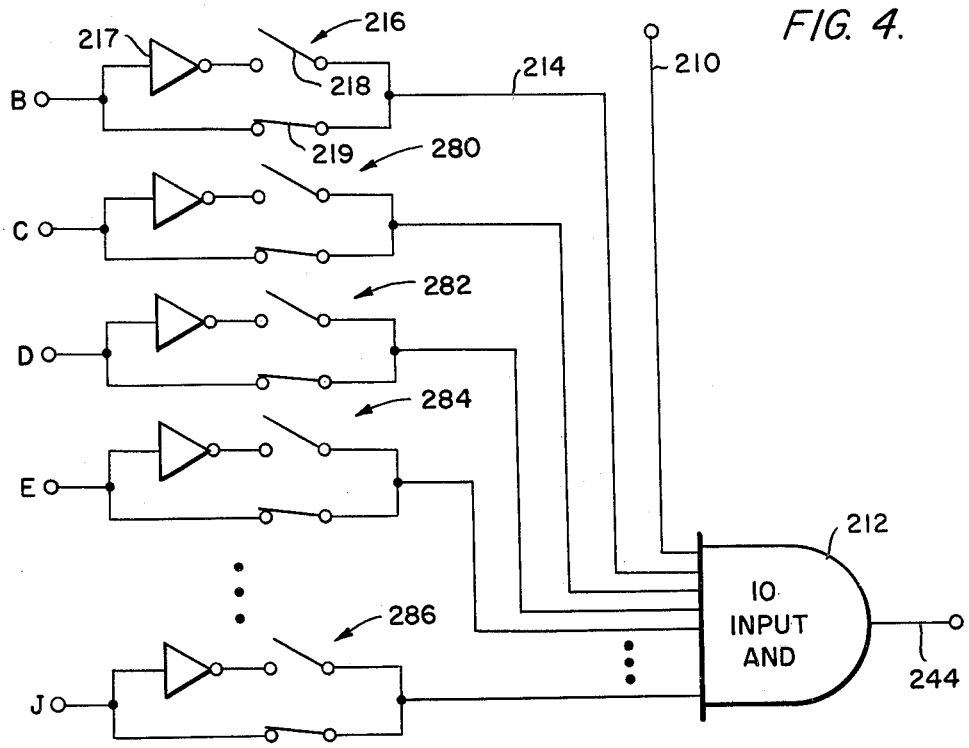
FIG. 4 is a schematic circuit diagram of the sensing unit identification system utilized in the present invention.

Referring now to FIG. 4, an expanded group of identification units is shown. Each successive one of these identification units, such as 280, 282, 284, and 286 is identical to unit 216 described above and produces an output signal connected to the 10-input AND gate 212. There is an identification unit, e.g., 216, 280, etc, for each of the nine address lines, and there is a group of nine such identification units for every remote sensing unit employed. Such groups are necessary in order to address each sensing unit individually. In the embodiment under discussion, wherein thirty-two sensing devices may be employed, there would be thirty-two groups of nine identification units identical to unit 216. The remaining tenth input to the 10-input AND gate 212 is derived from the exclusive OR gate driven by the comparator network and, in this example, the signal is produced on line 211 by exclusive OR gate 210. Although in this embodiment the identification units use switches, e.g., 218 and 219, these may be advantageously replaced with jumperspreset at the manufacturing and assembly site.

Figure 5:
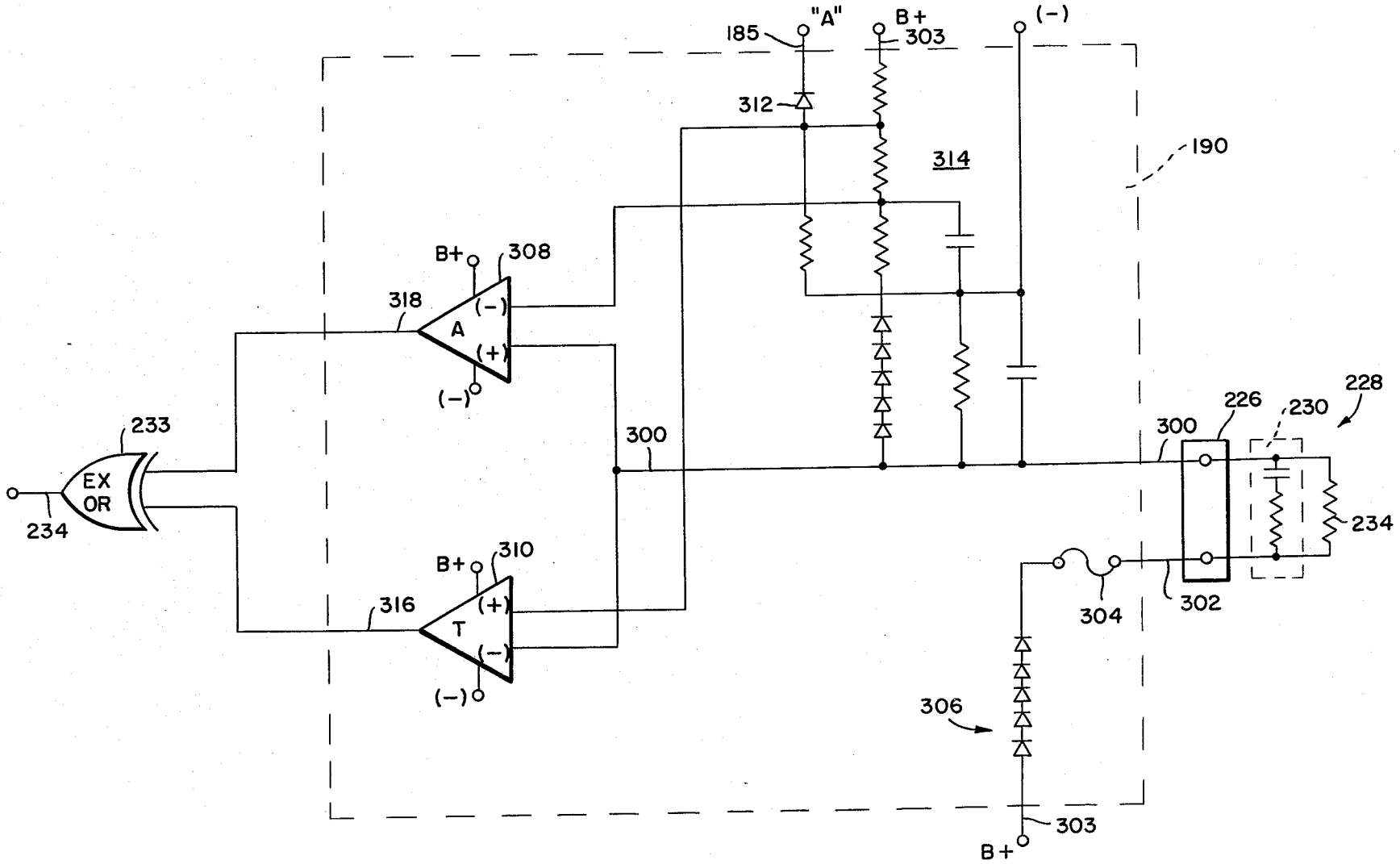
FIG. 5 is a schematic showing the comparators unit of FIG. 3B in more detail.

FIG. 5 shows the comparators unit 190 in more detail. The sensing unit 230 and the end of line resistor 234 are connected via plug-in connector 266 to lines 300, 302 which are input to the comparators unit 190. The sensing unit 228 is connected on line 303 to a voltage source for biasing it through a fuse 304 and a series of diodes, shown generally at 306. The output signal from the sensing 228 unit is on line 300 and is fed to the positive input of a first voltage comparator 308 and to the negative input of a second comparator 310. These two comparators 308, 310 are biased in the conventional fashion by connection to a suitable voltage source, such as the voltage on line 303 which energizes the sensing unit 228, this also completes the circuit of the sensing unit. The comparators 308, 310 compare two fixed microvolt reference signals with the return signal from the sensing device 230 and the end of line resistor 234. These comparators 308, 310 can detect open circuits, grounds, and alarms, and constantly monitor the sensing unit to assure that it is in its normal operating condition. A loss or reduction of return current on line 300 will activate trouble comparator 310 and an increase in return current will activate alarm comparator 308.

The microvolt reference voltages are actually provided by the least significant bit of the address, which is on the A line 185. Line 185 is fed through a diode 312 and a voltage divider network, shown generally at 314. The exclusive OR gate 233 operates such that if the two inputs to it are instantaneously different alarm and trouble, it will put out a pulse. Thus, in an alarm condition if the return signal on line 300 to the plus input of the alarm comparator 308 is the negative in relation to the LSB on the A line 185, then the output on line 318 of comparator 308 will go low. At the same time the output on line 316 from trouble comparator 310 would already have been low, because the plus input of comparator 310 would be negative. This is so because of that instant the negative portion of the A line pulse, possed by diode 312, is present at plus input 310, and in order for comparator 310 to produce a high output the plus terminal must be more positive than the voltage at the minus terminal. In the second (positive) half of the least significant bit, i.e., the A line, the minus input of alarm comparator 308 will be more positive than the return signal on line 300, because of the voltage divider 314, which keeps the output of alarm comparator 308 on line 318 low. The plus input of trouble comparator 310 will be positive in relation to the return line 300 voltage at the minus input, and output line 316 will be high. This in turn will mean that the output of exclusive OR gate 233 on line 234 will go high.

In a trouble condition, and during the half cycle when the LSB or A line 300 input to the minus terminal of the trouble comparator 310 will be negative in relation to the voltage at the plus terminal, due to the connection to the B+ line 303 and the voltage divider 314. Therefore, trouble comparator 310 will produce a high output on line 316. During this negative half cycle of the A line, the voltage level of the minus input to the alarm comparator 303 is more positive than the plus input on line 300 and line 313 output from comparator 308 goes low. It is noted that during a trouble condition, such as caused by the removal of the sensor 228, the voltage on the return line essentially goes to ground level. In the positive half cycle of the signal on the A line 185, the plus input to the trouble comparator 310 will be negative in relation to the return input on line 300, connected to the minus input of comparator 310, and the output on line 316 will go low.

Referring to FIG. 6, the clock generated time intervals or address line signals are shown. As indicated above, the present invention operates so as to halve the frequency of each successive signal which has the effect of doubling the wavelength. These address signals are produced by the clock and the divide by eight counter producing a 900 Hz signal that is buffered, shaped, and fed to a serial to parallel converter. This converter, 48 of FIG. 3A, has a single input line and ten output lines. The first output line corresponds to the A address line and the convertor acts to produce a single pulse for every two pulses occuring in the preceding stage. Thus, address line B contains one pulse for every two pulses on the A line and line J contains one pulse for two pulses appearing on line I.

Figure 7:
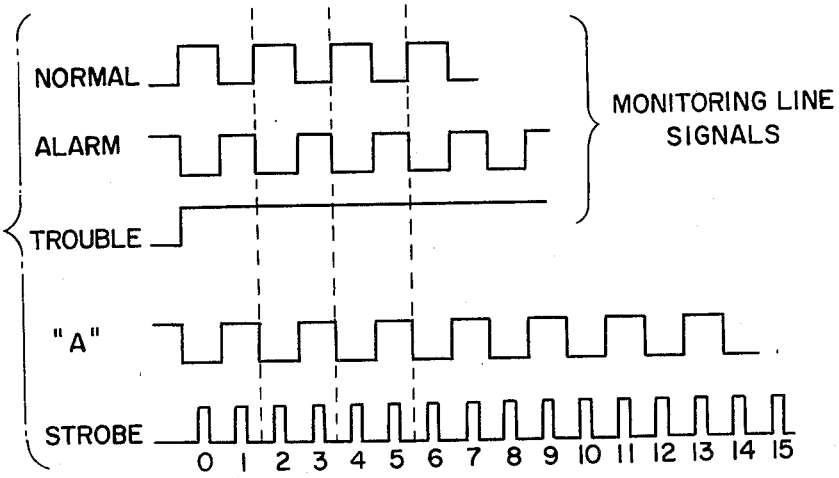
FIG. 7 is a graph of the waveforms indicating the outputs from a remote unit in its various states.

In describing the operation of the present invention, reference is had to FIG. 7. In FIG. 7 the strobe line signals appearing on line 58, as produced by the divide by eight counter 44 at a frequency of 1.8 KHz, serve to define the measurement interval. In this graph, the A line signal is arranged above the strobe signal, and the various signals which could possibly appear on the monitoring line 55 produced by the output transistor or amplifier 252, are arranged above the A line. Referring then to the monitoring line signals in FIG. 7, when the monitoring line signal goes low, in coincidence with the A line going low and then goes high, this represents an alarm condition at the particular sensing device being addressed. It should be remembered that each particular individual remote sensing unit is compared with the LSB of the address, i.e., the 900 Hz A line. As explained above, when the monitoring line stays high all the time, regardless of the state of the A line, this indicates a trouble condition. Again, if the monitor line tracks or coincides with the A line exactly, this represents an alarm condition.

As indicated above, each remote sensing device is provided with an end of line resistor so as to provide an impedence for the comparators to monitor. Should the actuating device become defective or inoperative, or should it be physically removed from the circuit, the comparators will cause the exclusive OR gate 233 to provide a high output to indicate that a trouble situation is at hand. The data line signal which occurs during an alarm condition tracks the LSB line exactly. This is due to the operation of the comparators and exclusive OR gate explained above. Conversely, the normal line is shifted in phase 180° from the LSB line.

It should be understood that the foregoing is presented by way of example only and is not intended to limit the scope of the present invention, except as set forth in the appended claims.

What is claimed is:

1. A remote sensing and control system, comprising:
generator means producing a clock signal;
first serial to parallel converter means connected to receive said clock signal and producing a first plurality of parallel address signals;
display means connected to receive said first plurality of parallel address signals;
second serial to parallel converter means remotely located from said first serial to parallel means and connected to receive said clock signals for producing a second plurality of parallel address signals identical to said first plurality of parallel address signals;
a plurality of sensor means each having a preselected address and having an altered electrical states upon sensing a selected parameter or upon the occurrence of a malfunction of said sensor means;
sensor input means having inputs connected to each of said plurality of sensor means and being connected to receive said second plurality of parallel address signals, for interrogating a selected one of said plurality of sensor means upon the occurrence of the address of the selected sensor means at said sensor input means and for producing a monitoring signal indicating the state of said sensor means; and
means feeding said monitoring signal to said display means for displaying the state of said sensor means during the occurrence of the address of the selected one of said plurality of sensor means.

2. The system of claim 1 further comprising:
logic means connected to receive said first plurality of parallel address signals for producing a synchronization signal upon the production of all of said plurality of parallel address signals, said synchronization signal being fed to said first and second serial to parallel converter means to reset said converter means so as to commence producing said plurality of parallel address signals anew.

3. The system of claim 1, further comprising:
computing means connected to receive said first plurality of parallel address signals from said first serial to parallel convertor means for producing a control signal upon the simultaneous occurrence of a previously selected address signal and a monitoring signal from the selected one of said plurality of sensor means;

a plurality of actuating means associated with selected ones of said plurality of sensor means and being remotely located from said first serial to parallel convertor means, each for performing a selected function; and means connected to receive said second plurality of parallel address signals and said control signal for producing an actuation signal fed to the corresponding actuating means during the occurrence of the address of the selected associated remote sensor means.

4. The system of claim 1, further comprising:

programmable read only memory means having a predetermined program contained therein and connected to receive said first plurality of address signals from said first serial to parallel convertor means for producing a control signal upon the simultaneous occurrence of a selected one of said plurality of address signals and a monitoring signal from the sensor means corresponding to the selected address signal;

a plurality of actuating means associated with selected ones of said plurality of sensor means and being remotely located from said first serial to parallel convertor means for performing a preselected function; and means connected to receive said second plurality of address signals and said control signal for producing an actuating signal fed to said actuating means during the occurrence of selected address signals and a monitoring signal.

5. The system of claim 1, further comprising:

multiplexer means including a plurality of manually actuatable switches for inserting an address of one of said plurality of sensor means and being connected to receive said first plurality of address signals from said first serial to parallel convertor means, for producing a control signal upon the occurrence of the address signal corresponding to the address set in said switches and a monitoring signal corresponding to the selected one of said plurality of sensor means;

a plurality of actuating means remotely located from said first serial to parallel convertor means for performing a selected function; and means connected to receive said second plurality of address signals and said control signal for producing an actuating signal fed to said actuating means during the occurrence of the address of the preselected remote sensor means.

6. The system of claim 1, wherein each of said plurality of sensor means includes a sensing element having altered electrical characteristics in the presence of a preselected environmental parameter, and an end-of-line resistor connected at parallel with said sensing element.

7. The system of claim 1, wherein said sensor input means includes a plurality of pairs of comparator means having the least significant bit of said plurality of address signals connected to an input of both comparator means and each of said plurality of sensor means connected to the remaining inputs of one of said pairs two comparator means, the outputs of said two comparator means being connected to the inputs to a logical OR gate from whose output is derived the monitoring signal.

8. The system of claim 7, wherein said sensor input means includes an identification means connected to said second plurality of address signals for providing a plurality of distinct identifiction signals each corresponding to a specific sensor means;

a multiple input logical AND gate having one input connected to the output of said logical OR gate and the remaining inputs to the outputs from said identification means, for producing an output signal when all inputs are in a corresponding state.

9. The system of claim 8, further including a transistor amplifier having an input from said multiple input logical AND gate and whose output comprises said monitoring signal.

10. The system of claim 3, wherein said sensor input means includes a plurality of pairs of comparator means, each pair having the least significant bit of said plurality of address signals connected to an input of both comparator means, the outputs of each pair of said two comparator means being connected to the inputs of a logical device having an output fed to one input of a multiple input AND gate and the remaining inputs connected to the outputs from identification means connected to said plurality of second address signals, said outputs comprising a plurality of distinct identification signals each corresponding to a specific sensing means, and multiple input AND gate producing an output signal when all inputs are in a corresponding state.

11. The system of claim 10, further including a logical AND gate having a first input connected to the output of said multiple input AND gate and a second input connected to the signal from said computing means, the output signal of said two input logical AND gate being connected to actuating means remotely located from said first serial to parallel converting means and being connected to a source of electrical power for performing a selected function upon the presence of the output signal from the two input logical AND gate.

12. A remote sensing and control system, comprising:

a signal generator producing a serial clock signal;

a centrally located serial to parallel convertor means connected to receive said serial clock signal for producing a first plurality of parallel address signals, each signal having a different wave length;

a centrally located display means connected to receive said first plurality of parallel address signals for providing an information display to an operator of the system;

a plurality of remotely located environmental parameter sensing means, each having associated therewith an individual address represented by the instantaneous values of said first plurality of parallel address signals at preselected times;

at least one remotely located serial to parallel convertor means connected to receive said serial clock signals for producing a second plurality of parallel address signals identical to said first plurality of parallel address signals;

a plurality of remotely located identification means connected to said plurality of sensing means and connected to receive said second plurality of parallel address signals for interrogating a selected one of said plurality of sensing means upon the occurrence of the address of the corresponding selected sensing means, for producing a monitoring signal indicating a sensed environmental parameter; and means connecting said monitoring signal to said display means for displaying the information in said monitoring signal during the occurrence of the address of the corresponding selected one of said sensing means.

13. The system of claim 12, further comprising centrally located logic means connected to receive said first plurality of parallel address signals for producing a synchronization signal upon the production of all of said plurality of parallel address signals, means connecting said synchronization signal to said centrally located serial to parallel convertor means and said at least one remotely located serial to parallel convertor means to reset both said convertor means so as to begin anew the production of said plurality of parallel address signals.

14. The system of claim 12, further comprising:

centrally located computing means connected to receive said first plurality of address signals and said monitoring signal, for producing a control signal during the occurrence of the monitoring signal and the portion of said plurality of parallel address signals corresponding to the address of the selected sensing means producing the monitoring signal;

a plurality of remotely located actuating means associated with selected ones of said plurality of sensing means for performing a selected function; and means connected to receive said second plurality of parallel address signals and said control signal for producing an actuating signal connected to said actuating means during the occurrence of the address of the selected associated remote sensing means.

15. The system of claim 12, further comprising:

centrally located programmable reading only memory means containing a program and being connected to receive said first plurality of address signals and said monitoring signal for producing a control signal during the occurrence of the monitoring signal and the portion of said plurality of parallel address signals corresponding to the address of the sensing means producing the monitoring signal;

a plurality of remotely located actuating means associated with selected ones of said plurality of sensing means for performing a selected work function; and means connected to receive said second plurality of parallel address signals and said control signal for producing an actuating signal connected to said actuating means during the occurrence of the address of the selected associated remote sensing means.

16. The system of claim 12, further comprising:

centrally located multiplexer means including a plurality of manually actuatable switches for inserting the address corresponding to selected ones of said plurality of sensor means and being connected to receive said first plurality of address signals and said monitoring signal, for producing a control signal during the occurrence of the monitoring signal and the portion of said parallel address signal corresponding to the address manually inserted by said plurality of switches;

a plurality of remotely located actuating means associated with selected ones of said plurality of sensing means for performing selected functions; and means connected to receive said second plurality of parallel address signals and said control signal for producing an actuating signal connected to said actuating means, said actuating signal being producing during the occurrence of the address of the selected remote sensing means.

17. The system of claim 12, wherein each of said plurality of sensing means includes a sensing element having altered electrical characteristics in the presence of said selected environmental parameter and an end-of-line impedance connected in parallel with said sensing element, for connection to the corresponding one of said plurality of remotely located identification means.

18. The system of claim 14, wherein each of said plurality of remotely located identification means includes a pair of comparator means having a selected one of said plurality of parallel address signals connected to the same input of both comparator means and the corresponding sensing means connected to the remaining inputs of said pair comparator means for producing an output connected to a logic device from whose output is derived the monitoring signal.

19. The system of claim 18, further including a multiple input logic device having one input connected to the output of said logic device from whose output is derived the monitoring signal and the remaining input to the outputs from said identification means for producing an output signal when all inputs are in a corresponding state.

20. The system of claim 19, further comprising a transistor amplifier having an input connected to the output of said multiple input logic device and an output which represents the monitoring signal.

21. The system of claim 19, further including a two input logical AND gate having one input connected to the output of said multiple input logic device and the other input connected to the control signal from said computing means, the output of said two input logical AND gate being connected to remotely located actuating means and being connected to a source of electrical power for performing a selected function upon the presence of the output signal from said two input logical AND gate.

* * * * *

UNITED STATES PATENT AND TRADEMARK OFFICE

CERTIFICATE OF CORRECTION

PATENT NO. :4,342,985

DATED : Aug. 3, 1982

INVENTOR(S) : Paul A. Desjardins

It is certified that error appears in the above-identified patent and that said Letters Patent are hereby corrected as shown below:

Column 14, line 24, "and" should be --said--.

Column 16, lines 14 and 15, "producing" should be --produced--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*